US006757401B2

(12) United States Patent
Uchimura et al.

(10) Patent No.: US 6,757,401 B2
(45) Date of Patent: Jun. 29, 2004

(54) MICROPHONE HOLDER

(75) Inventors: Satoshi Uchimura, Tokyo (JP); Osamu Kono, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 10/326,476

(22) Filed: Dec. 20, 2002

(65) Prior Publication Data

US 2003/0123689 A1 Jul. 3, 2003

(30) Foreign Application Priority Data

Dec. 27, 2001 (JP) ..... 2001-396129

(51) Int. Cl.[7] ..... H04R 25/00

(52) U.S. Cl. ..... 381/361; 381/361; 381/366; 381/355; 248/309.1

(58) Field of Search ..... 381/361, 364, 381/366, 365, 362, 363, 368, 355; 248/74.1, 309.1

(56) References Cited

U.S. PATENT DOCUMENTS 3,312,435 A * 4/1967 Malone ..... 248/115
3,665,490 A * 5/1972 Oskar ..... 381/366
4,040,547 A * 8/1977 Dickey ..... 224/247
4,100,653 A * 7/1978 Sensabaugh ..... 24/3.11
D305,026 S * 12/1989 Wolf ..... D14/229
5,460,346 A * 10/1995 Hirsch ..... 248/229.13
5,613,236 A * 3/1997 Tajima et al. ..... 455/351
5,640,742 A * 6/1997 White et al. ..... 24/3.12
6,029,817 A * 2/2000 Wilson, Jr. ..... 206/453
6,149,043 A * 11/2000 Goto ..... 224/669
6,286,736 B1 * 9/2001 Angus et al. ..... 224/269
6,381,338 B1 * 4/2002 Ou ..... 381/365
6,498,859 B2 * 12/2002 Kuerti et al. ..... 381/361

* cited by examiner

*Primary Examiner*—Curtis Kuntz
*Assistant Examiner*—Dionne Harvey
(74) *Attorney, Agent, or Firm*—Welsh & Katz, Ltd.

(57) ABSTRACT

The present invention provides a Dracula clip type of microphone holder, which enables further increase in the safe mounting during sticking or drawing of the pins on clothes of its wearer. The improved microphone holder comprises at least one microphone, a holder base member having front and back faces, a holder device slidably mounted on the front face of the holder base member for holding the microphone, and a hook pin having pin(s) on the side of the back face of the holder base member, the hook pin being rotatably supported at the approximate proximal end of the holder base member, in the direction of crossing the front or back face of the holder base member, such that the pins are extended from or retracted to the back face of the holder base member through slid movement of the holder device on the front face of the holder base member.

8 Claims, 3 Drawing Sheets

MICROPHONE HOLDER

FIELD OF THE INVENTION

The present invention relates to a microphone holder wore on and having use in positioning a mini-microphone to clothes at the chest thereof and so on, and particularly to a microphone holder having hook pin(s) with fangs shaped as stuck into and drawn from the cloth such that it is at the appropriate wore portion.

BACKGROUND OF THE INVENTION

The microphone holder in relationship with the instant invention is directed to a lavalier microphone (other name: pin microphone), which is often used in conferences or lectures and so on. Such type of microphone is of a type of mini-microphones, which are used by the woriness thereof on clothes at respective chests or collars, and provides use in hands-free fashion to the user, as its advantage.

The mounting of the microphone on the mounted portion such as clothes at the chest or collar has use of the special microphone holder. An example of the microphone holder is shown in FIG. 6. The microphone holder 1 comprises a holder base 2 which is of a flat plate member; a hold portion 3 disposed on one of surfaces (front surface (on the side of the upper face in FIG. 6)); and a hook pin 4 disposed on the other (back surface (on the side of the lower face in FIG. 6)).

The hold portion 3 has a grooved fit 30 forming cross section like the letter C at its center portion so as to fit a microphone (not shown), therein. The hook pin 4 comprise two parallel linear members each having integral mounting to the holder base 2, on the side of one end, and arrangement of protuberant fangs with respective leading ends each having a sharp point shaped like a needle for easier stacking thereof into the wore portion, on the side of the other end. Because of the appearance of the hook pin 4 like fangs, such microphone holder 1 is called a Dracula clip.

This construction is facile in mounting of the microphone, wherein the user has the holder base 2 with hold of the microphone, by hand, and sticks the hook pin 4 into the clothes such as collars or chests.

However, since such microphone holder 1 with facileness of its mounting and removal always provides protrusion from the holder base 2 with the hook pin 4, it involves the danger of sticks of the hook pin 4 into the user's fingers or body at being stuck, and thus requires solution to this most serious problem.

SUMMARY OF THE INVENTION

The instant invention is directed to a microphone holder, which comprises a microphone; a holder device for holding the microphone; a holder base member formed having front and back faces, and side surfaces between said front and back faces, the holder base member being provided on the front face of the holder base member; and hook pin(s) provided on the holder base member on the opposite side from the holder member.

The objectives of the instant invention are directed to solution to the problem as stated above, and the first provides avoidance of injuriousness to finger(s) or a body of a microphone holder's wearer by the sticking and drawing of the pin(s) and allows the safer wear, and the second provides increase in the force which provides retention of the firm securement, and hence provides avoidance of coming-off of the microphone holder due to movement of the wearer's body.

The avoidance of injuriousness to finger (s) or a body of a microphone holder's wearer by its sticking pin(s) will be accomplished by providing an improved microphone holder. The objective microphone holder may have any mechanism capable of extending operation of the hook pin as well as the retracting one. For the increase in the firm securement, the improved microphone holder may have any mechanism capable of the locking operation of its holder device to hold a microphone.

The forgoing first mechanism comprises a V-shaped hook pin member rotatably supported about the proximal end of the holder base member thorough its proximal portion, in the direction of crossing the front or back face of the holder base member. The V-shaped hook pin member comprises a proximal part, at least one pin connected to the proximal part and extending from the one thereof, and a lever connected to said proximal part and extending from the other thereof.

Such hook pin may be of the two as formed in a fang-shape. Each of the pins may be of a shape like needle or thorn, which sticks in a cloth and so on.

With this construction of the first mechanism, when the lever is extended from the holder base member, the pin(s) are retracted into the holder base member by action of the lever(s), and when the lever(s) are retracted into the holder base member, the pin(s) are extended from the holder base member by action of respective levers.

The extension or retraction of the lever(s) from or into the base member is performed by a slider. The slider comprises a pair of slide grooves, and at least two slide elements slid through said slide grooves.

Preferably, such V-shaped hook pin member may comprise one or more torsion springs having a spring hinge forming a proximal part. With this construction, the springs each may produce force applied to the proximal part to which both of the lever and the pin are linked, and thus the resilient springs permit the whole hook pin member to have its own play even at generation of its slight play or torsion by the repeated use.

The holder device further comprises a means for operating to cause extension or retraction of said lever(s) in response to slide of the slide element(s) on slide groove(s).

The operation means of the holder device may be of a protrusion protruding from the holder base member. Preferably, the protrusion has a slope surface formed at its leading end and inclined along the moving direction of the slide elements of the slider. The slope surface has contact with the lever of the hook pin member. When the slide elements are slid on the slide grooves, such lever(s) go up or down from the slope surface so that extraction or retraction of the lever(s) from or into the front face of the holder base member is performed, and hence extraction or retraction of the pin(s) from or into the back face of the holder base member is performed.

Lock of the hook pin being extended or retracted is performed by a lock mechanism as a second mechanism. The lock mechanism allows lock of the hook pin to a sliding area as formed by both of the holder base member and the holder device. Preferably, the lock mechanism comprises recess(es) provided on the holder base member, and protrusion(s) provided on the holder device.

The pins of the hook pin, which are retracted to the back face of the holder base member, are received in a reception part provided on the back face of the holder base member. The reception part may comprise a recesses area forming inward or backward walls on the back face of the holder base member, or a surrounded area having walls protruding from the back face of the holder base member such that the pin(s) of the hook pin hide therein. Thus, it provides avoidance of injuriness to the fingers or body of the user due to stacking and drawing of the pin(s).

BRIEF DESCRIPTION OF THE DRAWING

In FIG. 1, FIGS. 1A, and 1B are plain, and side views of a microphone holder according to an embodiment of the present invention, respectively;

In FIG. 3, FIGS. 3A, and 3B are a side view, and a section on B—B line of the microphone holder of the above-stated embodiment, respectively;

In FIG. 5, FIGS. 5A, and 5B are depictions depicting a process for using the microphone holder of the above-stated embodiment, respectively; and In FIG. 6, FIGS. 6A, and 6B are front, and side views of a conventional microphone holder, respectively.

PREFERRED EMBODIMENT OF THE INVENTION

In the following, description of the embodiments of the instant invention is given together with reference to drawings.

Figure 1A:
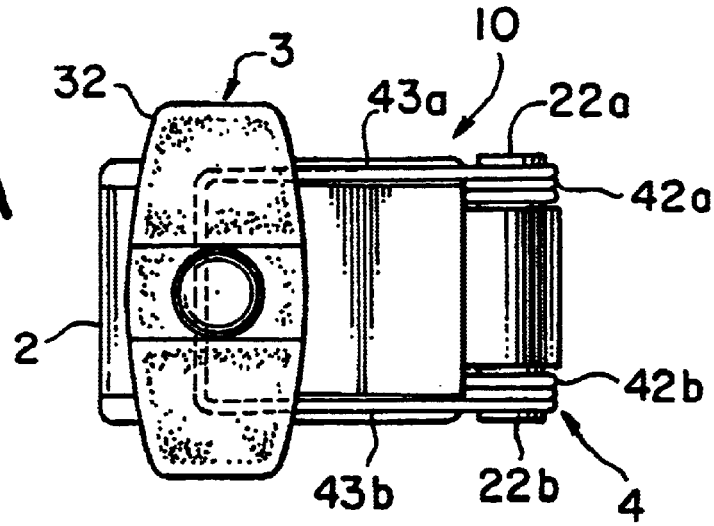
Figure 1B:
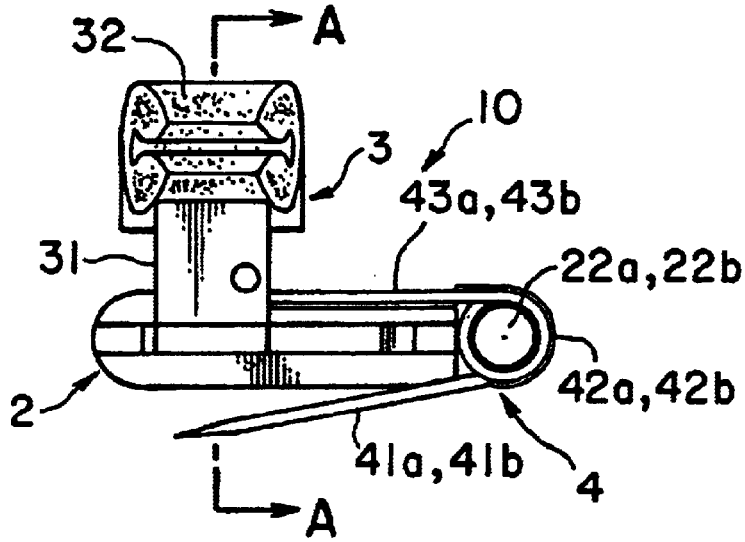
Figure 2:
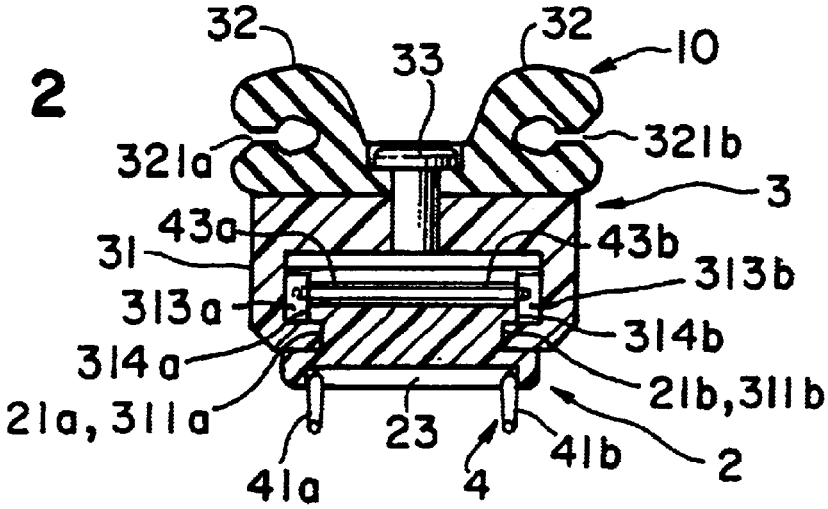
FIG. 2 is a section on A—A line of the microphone holder of the above-stated embodiment.
Figure 6A:
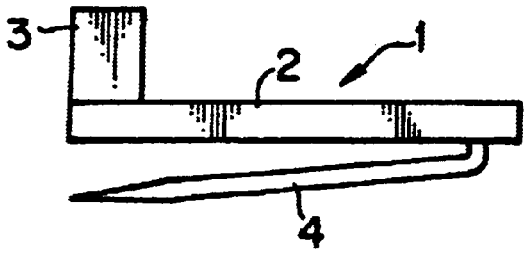
FIG. 6A Prior Art
Figure 6B:
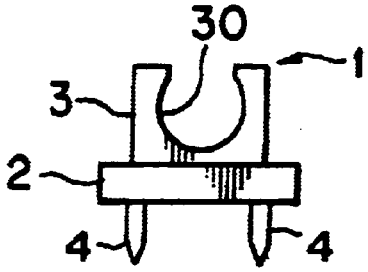
FIG. 6B Prior Art

In FIG. 1, FIGS. 1A and 1B, which are shown, are plain and side views of completed assemblage of a microphone holder, respectively, and FIG. 2 is a sectional view as taken along a line A—A in FIG. 1. Their some structural elements are with use of numerals the same as ones in FIG. 6, which are the same as or regarded as the same as ones in FIG. 6.

Referring to FIGS. 1A and 1B, there is shown a microphone holder 10, which comprises a holder base member 2 employable as a base of the united assemblage thereof, an assembled holder device 3 disposed on and having possible slides along the holder base member 2 for removably holding a microphone (not shown), and an assembled hook pin 4 mounted on the holder base member 2, the pins being stuck into and drawn from clothes at its mounted portion such as a chest portion.

Figure 3A:
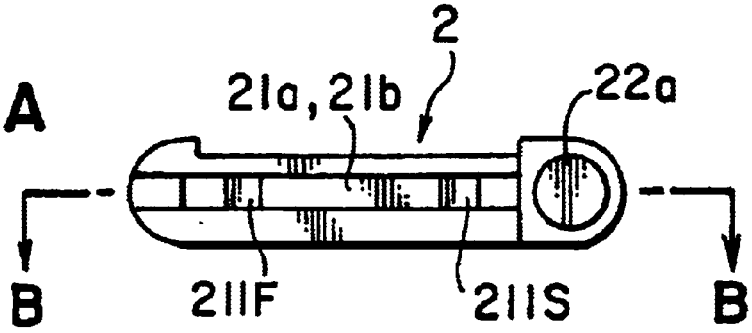
Figure 3B:
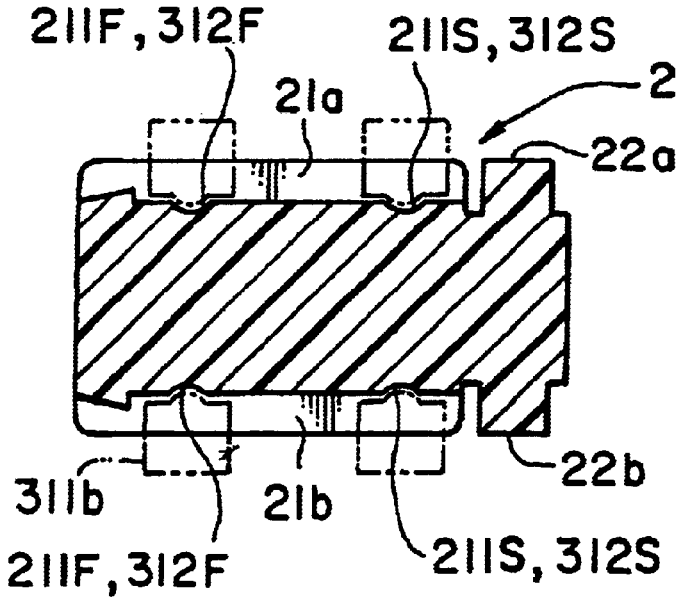

Referring to FIGS. 2 and 3A and 3B, the holder base member 2 comprises a synthetic resin flat plate having front and back faces (top and lower faces according to FIG. 2) and side surfaces combined with formation of a predetermined thickness between the front and back faces (top and lower faces according to FIG. 3A), the two side surfaces arranged in parallel having respective slide grooves 21*a*, 21*b* through which the holder device 3 as shown in FIGS. 1B and 2 is slidably carried thereon.

In FIGS. 2 and 3, the grooves 21*a*, 21*b* of the holder base member 2, which are arranged on respective external side surfaces as opposed to each other of the holder base member 2, have paired recesses 211F, 211S, respectively, formed on the side of the leading and trailing ends thereof. Thus, the holder base member 2 has four in total of such recesses. Each of the recesses are formed in a curved surface. The curving recesses, respectively, are structural elements as one elements of a lock mechanism for locking the hold device 3 at its predetermined positions through recess and protrusion engagement with curved projecting surfaces 312 as the other elements, as stated in the following, of the holder device 3 being fitted in paired grooves 21*a*, 21*b*, as one member of the two.

With regard to the hook pin 4 of the microphone holder 10, it comprises a metallic linear member having needle-like sharp points at respective leading and trailing ends. The holder base member 2 has bearing elements 22*a*, 22*b* provided at respective external side surfaces as opposed to each other on the side of one ends thereof. With this construction of the holder base member 2, as shown in FIGS. 1A and 1B, the metallic linear member is bent around the upper bearing element 22*a* with formation of an upper torsion spring and a shape like letter V between the upper pin 41*a* and lever 43*a* extending to a predetermined length in the direction of crossing the front or back face of the holder base member 2. Then, from the predetermined length position of the upper lever 43*a*, the metallic linear member is bent downward, run to a point at the lower surface of the holder base member 2, and bent and run to the lower bearing element 22*b* such that the lower lever 43*b* with parallel arrangement with the upper lever 43*a* is formed. It is bent around the lower bearing element 22*b* with formation of a lower torsion spring and shape like letter V between the lever 43*b* and the lower pin 41*b* extending from said lower torsion spring, in parallel with the upper pin 41*a*.

With the construction of the metallic linear member as stated above, the hook pin 4 may have proximal parts 42*a*, 42*b* which are subjected to rotation about respective upper and lower bearing elements 22*a*, 22*b*. The proximal parts 42*a*, 42*b* each are at generally the center portion of the hook pin 4, where the upper and lower torsion springs are formed. Thus, the hook pin 4 comprises a double torsion spring as combined with the holder base member 2, with produced strain force.

However, the hook pin may be of construction of a single torsion type torsion spring in the two as combined with the holder base member 2. The instant invention may include such exemplified variances.

In addition, as shown in FIG. 2, the holder base member 2 has a reception part 23 provided on the back face thereof for receiving the pins 41*a*, 41*b* of the hook pin 4, as stated in the following in detail.

The holder device 3 is provided on a slide 31 fitted on and possibly slid along the front face of the holder base member 2, and has a holder member 32 for essentially holding a microphone (not shown).

Figure 4:
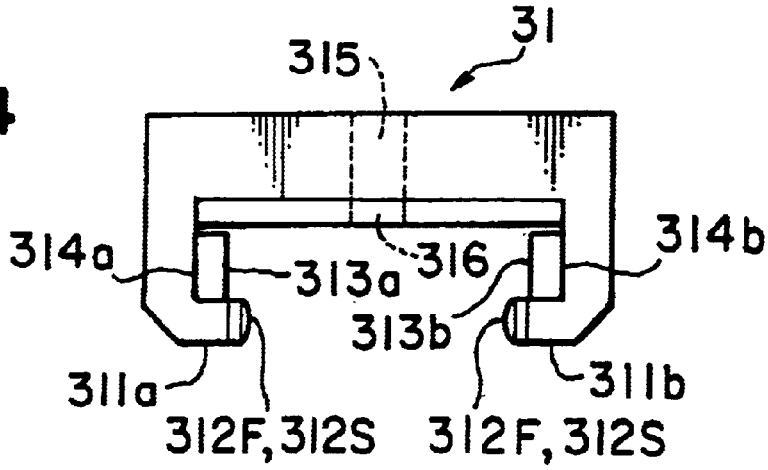
FIG. 4 is a front view of a slide in the above-stated embodiment.

In FIG. 2 as well as FIG. 4, the slide 31 comprises a member with cross section like letter C, wherein the opening area resides on the side of the front or back face of the holder base member 2, and may be formed by combination of the front wall (upper wall according to FIGS. 2 and 4), and the upper and lower walls (right and left walls according to FIGS. 2 and 4) backwardly extending from the front wall. The extending upper and lower walls of the slide 31 have respective slide ribs 311*a*, 311*b* formed by forwardly or inwardly bending leading ends of respective upper and lower walls to generally the right angle and extending toward respective opposing upper and lower walls. Such slide ribs 311*a*, 311*b* of the slide 31 are removably fitted or received in respective grooves 21*a*, 21*b* of the holder base member 2 so that the slide 31 may have sliding movement along the front face of the holder base member 2.

With regard to the curved projecting surfaces 312F, 312S as the other element of the lock mechanism providing lock of the holder device 3 at the predetermined position, as stated above, they are provided at the leading ends of respective slide ribs 311*a*, 311*b* of the slide 31, engagement of the curved projecting surfaces 312F, 312S of respective upper and lower slide ribs 311*a*, 311*b* of the slide 31 with the curved recesses 211F, 211S of respective grooves 21*a*, 21*b* of the holder base member 2 performing hold of the holder device 3 to the predetermined position.

At or about respective slide ribs 311*a*, 311*b* of the slide 31 or respective surface thereof opposite front, respective projecting elements 313*a*, 313*b* are provided. Thus, at the mounting of the holder device 3 to the holder base member 2 on the front side thereof, the projecting elements 313*a*, 313*b* project from the holder base member 2 outward or forward. Such projecting elements 313*a*, 313*b* are located at respective upper and lower edges of the front face of the holder base member 2. At the upper and lower edges of the holder base member 2, there are provided with cut portions 314*a*, 314*b* cut back so that the projecting elements 313*a*, 313*b* are fitted or located in respective cut portions 314*a*, 314*b*.

In regard to the holder element 32, as shown in FIG. 2, it comprises elastic or resilient materials such as foamed rubber, and may form a pair of clips 321*a*, 321*b* with cross section approximately like letter C for hold of a microphone (not shown), which are on respective right and left sides (upper and lower sides according to FIG. 1A). Between the pair of clips 321*a*, 321*b* on the holder device 3, there is formed with a first thread hole 315 such that a screw 33 is threaded thereinto and further threaded into a second thread hole 316 centered on the front wall of the slide 31, and thereby holder element 32 is fixed to the slide 31.

Figure 5A:
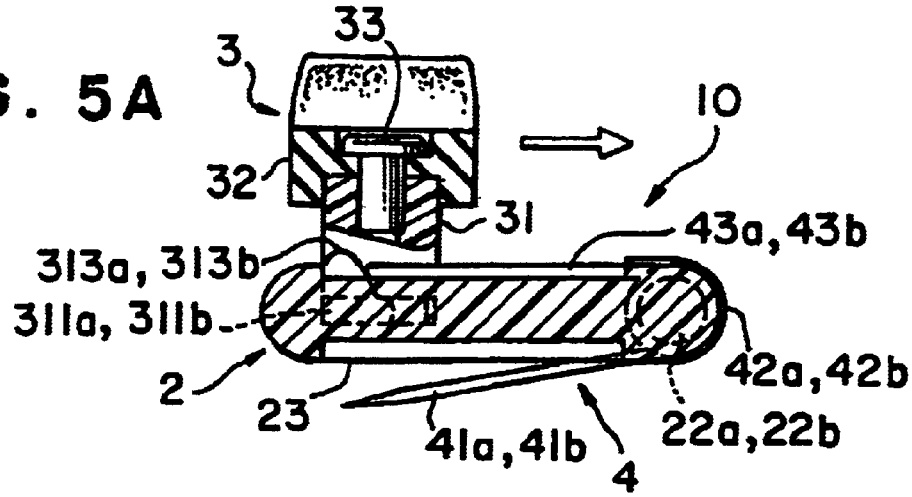
Figure 5B:
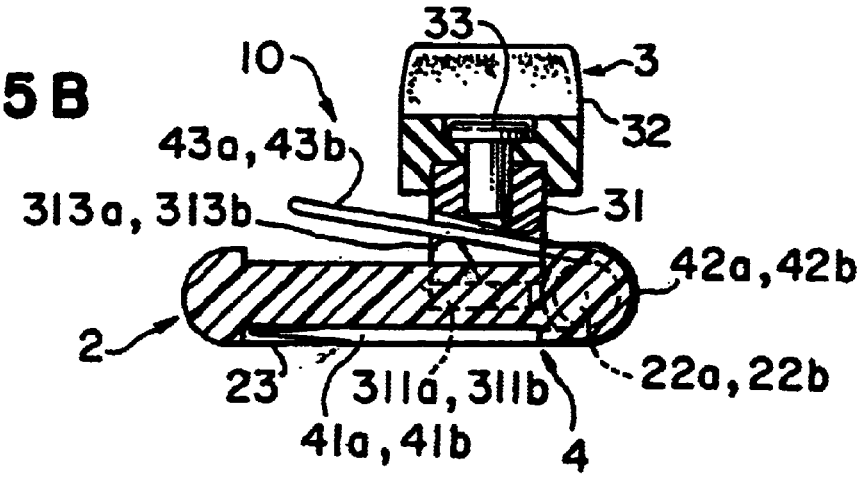

Referring to FIGS. 5A and 5B, the outwardly projecting portions of the projecting elements 313*a*, 313*b* with respect to the holder base member 2 have sloping surfaces, respectively. Both of the sloping surfaces are formed along the sliding direction of the holder device 3, wherein the levers 43*a*, 43*b* of the hook pin 4 at the portions opposite the front face of the holder base member 2 touch on the corresponding sloping surfaces of the projecting elements 313*a*, 313*b* such that the slide movement of the slide 31 between the right and left sides creates forward or backward movement of the lever 43*a*, 43*b* of the hook pin 4. Thereby, the pins 41*a*, 41*b* come out from or go back into the reception portion 23 of the holder base member 2.

Formation of clips 321*a*, 321*b* according to the foregoing embodiment is made by cutting away a part of the foamed rubber forming the holder element 32. However, the holder element 32 may have the free configuration under the condition of at least construction for possible hold of a microphone. For example, the hold of a microphone may be of construction by fitting of the microphone into alligator clips, or a wound lineal member. In the present invention, such holder element 32 is provided as optional construction, and may comprise the appropriate shape to be elected, according to the invention.

Next, description of a method of using the microphone holder 10, with reference to FIG. 5 will be made.

Of FIG. 5, FIGS. 5A, and 5B show the condition where the microphone holder 10 may be used as the pins 41*a*, 41*b* of the hook pin 4 being extended therefrom, and the condition where the microphone holder 10 is not used as the pins 41*a*, 41*b* going down (being received), respectively.

Referring to FIG. 5A, when the microphone holder 10 is used, leftward slide of the holder device 3 are made in a manner permitting release of the lever 43*a*, 43*b* of the hook pin 4 from the holder base member 2, wherein the levers 43*a*, 43*b* of the hook pin 4 have possible free backward or forward rotations about the proximal parts 42*a*, 42*b* so that the pins 41*a*, 41*b* in the reception part 23 on the opposite side of the holder base member from the levers 43*a*, 43*b* of the hook pin 4 may be extended from the reception part 23.

Lock of the holder device 3 by the first lock means which comprises engagement of the curved projecting element 312F of the slider 31 with the curved recess 211F of the holder base member 2 provides retention of hold of the holder device 3 at the first position. This is of assistance to facilitate, as shown in FIG. 5A, sticking the pins 41*a*, 41*b* of the hook pin 4 through clothes at the collar or chest (not shown) to allow safe mounting of the microphone holder 10 to the mounting position.

After the pins 41*a*, 41*b* are stuck into appropriate mounting portions, lock of the holder device 3 by the lock mechanism may be released so as to permit desirable slide of the holder device 3 in the right direction. Thus, when the holder device 3 is slid toward the right from the predetermined position by its wearer, the levers 43*a*, 43*b* of the hook pin 4 go up the sloping surfaces 313*a*, 313*b* of the slider 31 or have forward rotation, as shown in FIGS. 5A to 5B, whereby the pins 41*a*, 41*b* are retracted into the reception part 23 of the holder base member 2.

Then, at complete retraction of the pins 41*a*, 41*b* into the reception part 23, the holder device 3 is locked at the second position by the second lock means which comprises engagement of the curved projecting elements 312S of the slider 31 with the curved recess 211S of the holder base member 2. Hence, the pins 41*a*, 41*b* are firmly retained in the reception part 23, while the microphone holder 10 is positioned at the mounting position where the holder base member 2 may produce a considerable force which catches the pins 41 therein.

At no use of the microphone holder 10, the holder device 3 may be slid to be at the right curbed recess 211S, as shown in FIGS. 3B and 5B. Such microphone holder 10 provides sliding movement of the holder device 3 from the left to the right to cause the levers 43*a*, 43*b* of the hook pin 4 to go up the sloping surfaces of respective projecting elements 313*a*, 313*b* so that the levers 43*a*, 43*b* of the hook pin 4 come out from the holder base member 2. Thus, the pins 41*a*, 41*b* opposite from the levers 43*a*, 43*b* are pulled toward the reception part 23 of the holder base member 2. Hence, retraction of the pins 41*a*, 41*b* into the reception part 23 may be made.

This construction according to the present invention will provide a microphone holder 10 which is handled for mounting or removal thereof by hand of its user, in a condition of no extension of the pins 41*a*, 41*b* from the holder base member 2, it does not cause the pins 41*a*, 41*b* to injure to fingers of the user, and may provide the safety sticking or drawing of the pins to the user.

According to the above-stated embodiment, movement of one spring arm (levers 43*a* and/or 43*b*) up (to front) and down(to back) with respect to the V-shaped hook pin 4 provides extension and retraction of the other spring arm (pins 41*a* and/or 41*b*). However, in the mechanism other than that described above, if any mechanism(s) capable of the extending and retracting operation of the hook pin 4 by means of slide of the holder device 3 are, they may be applied suitable. Thus, such variations or modifications also may be involved in the scheme of the present invention.

As described above, the present invention may provide a holder device disposed slidably on a front holder base member along it, and a hook pin permitted to perform its extension and retraction by the holder device being slid, and thus avoids injuriousness to finger(s) or a body of the microphone holder's wearer by its sticking or drawing pin(s), and allows the safer wear.

In addition, it also allows increase in the force which provides retention of the firm securement, and hence provides avoidance of coming-off of the microphone holder due to movement of the wearer's body.

What is claimed is:

1. A microphone holder comprising microphone(s); a hold device for holding said microphone(s); a holder base member formed having front and back faces, a proximal end, and a plurality of side surfaces between said front and back faces; a slide means provided at said front face of said holder base member for allowing slide of said holder device on said front face of said holder base member, the slide means comprising at least a pair of slide grooves provided on respective external side surfaces of said holder base member, having opposing arrangement to each other; and at least a pair of slide elements provided to said holder device with fitting into said slide grooves; a V-shaped member rotatably supported about the proximal end of said holder base member at its proximal part with horizontal rotation in the direction of crossing the front or back face of said holder base member, the V-shaped hook pin member comprising said proximal part, at least one pin connected to said proximal part and extending from the one thereof, and a lever connected to said proximal part and extending from the other thereof, the lever extending from or retracting to the holder base member about said proximal part in response to slide of said slide elements on said slide grooves, said pin extending from said holder base member when said lever means being retracted into said holder base member, said pin retracting into said holder base member when said lever means being extended from said holder base member.

2. The microphone holder of claim 1, wherein said V-shaped hook pin member comprises at least one torsion spring with formation of a spring hinge forming at said proximal part.

3. The microphone holder of claim 1, wherein said pin of the V-shaped hook pin member is paired in general parallel arrangement and connected with respective levers paired, through respective proximal parts each having a spring hinge formed as a torsion spring, the V-shaped hook pin being unitary formed or formed in pairs separately.

4. The microphone holder of claim 1, wherein said holder device further comprises a means for operating to cause said lever to be extended from or retracted into said holder base member.

5. The microphone holder of claim 4, wherein said operation means comprises at least one projection protruding from the front face of said holder base member, the projection having a slope surface formed at its leading end and inclined along the moving direction with respect to said slide element of said slide means, the lever of said hook pin going up said slope surface for the extension from the holder base member, while going down from said slope surface for the retraction into the holder base member, in response to the slid movement of said slide element on said slide grooves of said slide means.

6. The microphone holder of claim 1, said microphone holder further comprising at least a pair of lock means, the pair of lock means comprising a first lock part for retaining lock of said pin extending to the predetermined position from said holder base member, and a second lock part for retaining lock of said pin completely retracting into said holder base member, the first and second lock parts each comprising a first lock element provided on the side of the front face of said holder base member, and a second lock element provided on the side of the slide element of said holder device.

7. The microphone holder of claim 6, wherein said first lock element comprises a recess, and said second lock element comprises a protrusion engaging said first lock element.

8. The microphone holder of claim 1, wherein the back face of said holder base member has a reception area in which the retracted pins of said hook pin are hidden, the reception area being formed by providing walls recessing into or extending from the back face of said holder base member.

* * * * *